United States Patent [19]

Rose, Sr. et al.

[11] 4,046,165

[45] Sept. 6, 1977

[54] VALVE-POSITIONING APPARATUS

[75] Inventors: Robert C. Rose, Sr.; Harold H. McClelland, both of Akron, Ohio

[73] Assignee: IBEC Industries, Inc., New York, N.Y.

[21] Appl. No.: 583,844

[22] Filed: June 4, 1975

[51] Int. Cl.[2] ..... F15B 13/043

[52] U.S. Cl. ..... 137/624.27; 91/433; 137/625.64; 137/625.66; 137/625.69; 251/30; 251/31

[58] Field of Search ..... 91/433; 137/624.27, 137/625.6, 625.64, 625.66, 625.69; 251/27, 30, 31, 63.4

[56] References Cited

U.S. PATENT DOCUMENTS

| | | | |
|---|---|---|---|
| 321,426 | 7/1885 | Ells | 137/487.5 |
| 2,342,812 | 2/1944 | Martinson | 91/433 X |
| 2,575,719 | 11/1951 | Leeds | 137/625.64 X |
| 2,591,800 | 4/1952 | Gardiner | 137/625.64 X |
| 2,732,860 | 1/1956 | Ray | 137/625.64 |
| 2,852,948 | 9/1958 | Renick | 137/625.64 X |
| 2,861,592 | 11/1958 | Collins | 137/625.64 |
| 2,919,679 | 1/1960 | Lincoln et al. | 137/625.69 X |
| 2,955,617 | 10/1960 | Collins | 137/625.64 |
| 2,982,306 | 5/1961 | Fitzgibbon | 137/625.64 |
| 3,011,519 | 12/1961 | Brinkel et al. | 137/624.27 |
| 3,040,768 | 6/1962 | Pippenger | 137/625.64 X |
| 3,083,729 | 4/1963 | Poorman | 137/625.69 |
| 3,511,276 | 5/1970 | Jessen et al. | 137/624.27 |
| 3,572,378 | 3/1971 | Hartwick et al. | 137/624.27 X |
| 3,640,146 | 2/1972 | Barnes | 137/624.27 X |
| 3,712,686 | 1/1973 | Kersting | 303/71 |
| 3,736,958 | 6/1973 | Rostad | 137/625.64 X |
| 3,874,414 | 4/1975 | Dollison | 137/625.66 |

FOREIGN PATENT DOCUMENTS

| | | | |
|---|---|---|---|
| 1,272,660 | 7/1968 | Germany | 137/625.64 |
| 1,288,389 | 1/1969 | Germany | 137/625.64 |
| 1,228,827 | 4/1971 | United Kingdom | 137/624.27 |
| 740,225 | 11/1955 | United Kingdom | 137/625.64 |

*Primary Examiner*—Alan Cohan
*Assistant Examiner*—Gerald A. Michalsky
*Attorney, Agent, or Firm*—Price, Heneveld, Huizenga & Cooper

[57] ABSTRACT

Valve-positioning apparatus especially adapted for use with fluid-operated spool valves for positioning the spool member of such a valve in a predetermined position whenever the valve is not operating such as upon installation or during shutdown. In the preferred embodiment, the positioning apparatus includes a piston member normally held out of contact with the spool by fluid pressure but urged into contact with the spool to position the spool when fluid pressure fails or is absent. The positioning apparatus may be used on either or both ends of the spool valve.

16 Claims, 5 Drawing Figures

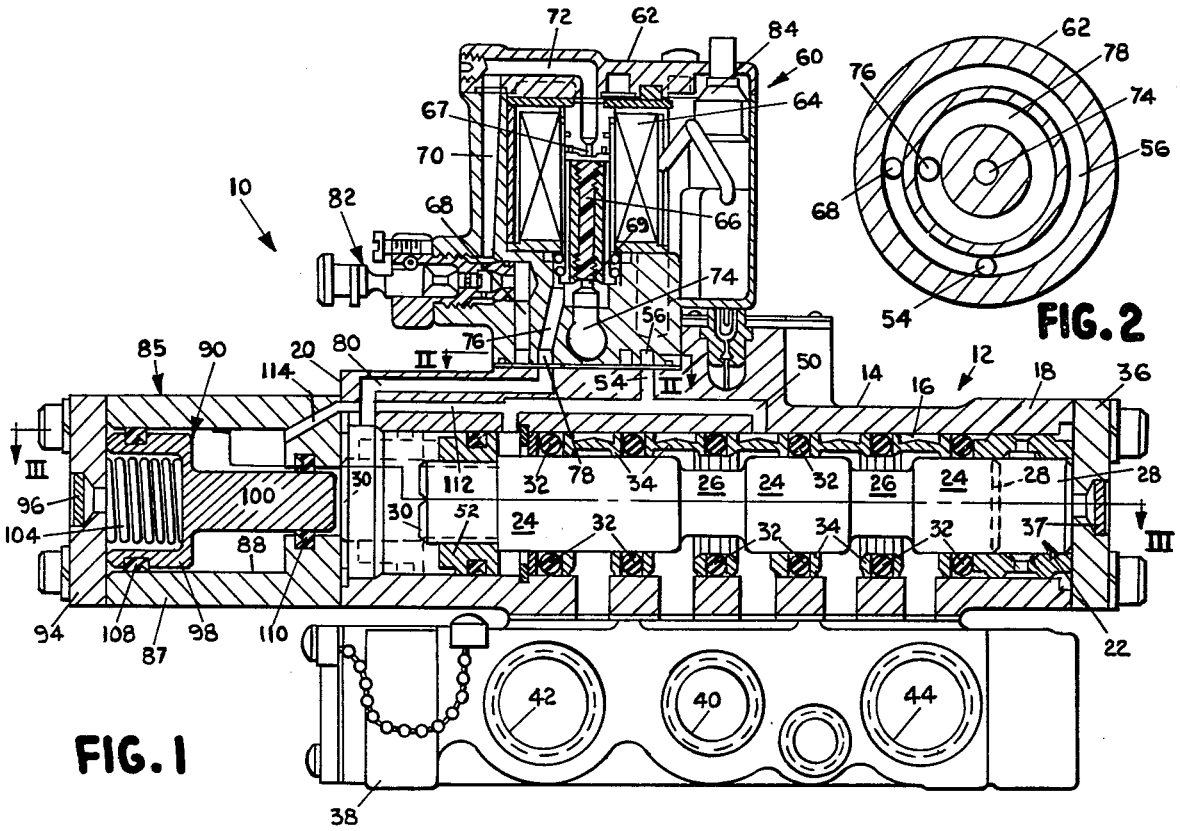
FIG. 1
FIG. 2
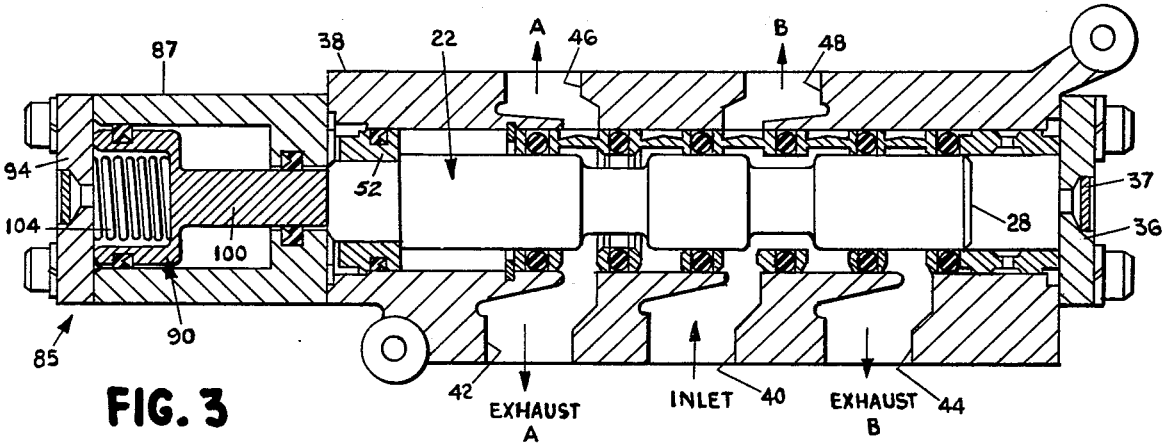
FIG. 3
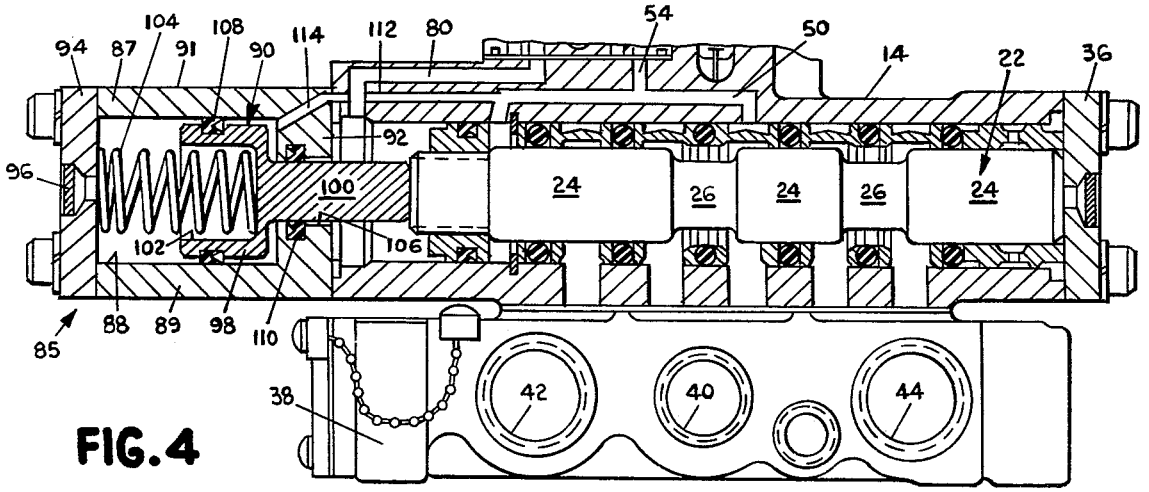
FIG. 4

VALVE-POSITIONING APPARATUS

BACKGROUND OF THE INVENTION

This invention relates to devices for controlling the position of movable valve elements for positioning such elements when the valve is not operating and, more particularly, to a positioning apparatus especially useful with spool valves for positioning the spool upon installation of the valve, during shutdown, or at any other time the valve is not operating.

A major concern in industry using machinery and other devices controlled by valves, and especially pneumatic, hydraulic, and other fluid valves, is the accurate determination of the position of the movable valve element within the valve. Such position determination is important upon initial installation, loss of fluid pressure when in service, or during replacement of the valve so that operation of the controlled machinery can be accurately predicted. Without such determination, a press, punch, or ram device controlled by a valve can be unexpectedly and inadvertently operated upon start-up or return of fluid pressure resulting in serious injury to operators, maintenance personnel, or the like. The problem is especially serious when using fluid-type spool valves including a shiftable spool element which can be moved to any one of a plurality of positions to control the passage of pressurized fluid through various fluid conduits.

One well-known method for positioning the spool of a fluid-operated spool valve is to use a spring acting on either one or both of the ends of the spool valve such that the spring or springs automatically return the spool to a determined or neutral position. It has been discovered, however, that such method has several drawbacks because of the necessity of providing sufficient spring force to shift the spool to the predetermined position. Namely, the constantly contacting spring increases the minimum permissible operating pressure of the valve and causes an inbalance of forces acting in one direction of spool movement. Further, the spring itself is cycled at the same rate as the valve subjecting it to fatigue and wear, necessitating frequent maintenance, and reducing the reliability of the positioning apparatus. Thus, the normal operating function of a spool valve is severely altered with such prior known positioners.

A second method widely used for positioning spool valves of the double solenoid, two-position type are detents designed to hold the spool in one or both of its two extreme positions. Such detents normally include holding members biased into contact with recesses or the like on the spool itself. Such detents also are disadvantageous because they raise the valve's minimum operating pressure thereby requiring an additional force to unlock the spool and start its motion. If the fluid system somehow fails during the movement of the spool, the spool may coast to a stop before reaching one of the locking detents thereby preventing accurate determination of its position as mentioned above.

It has now been discovered that the present invention eliminates the above problems by providing a positioner which is actuated only if the system is shut down, depressurized or otherwise not operating. The device remains ready for actuation at all times but is unused until called upon thereby prolonging its life to an extent greater than for any known positioning apparatus. Further, the device avoids the necessity of an additional force to move the spool, causes no imbalance of forces acting upon the spool and is cycled only at a fraction of the repetitions to which the spool is ordinarily subjected. The present invention, therefore, allows a designer to accurately determine the position of the valve at all times during start-up thereby increasing the safety and realibility of systems controlled by the valve.

SUMMARY OF THE INVENTION

Accordingly, it is an object and feature of the present invention to provide a valve positioning apparatus which automatically and reliably positions a movable valve member in a predetermined position and yet is actuated to position that valve member only when the valve is being installed, shut down, depressurized, or is otherwise not operating in its normal manner. The apparatus is especially useful with spool valves which open and close a plurality of fluid passageways communicating therewith such that the movable spool member of such a valve is automatically located in a predetermined position when the spool valve is not operating.

The positioning apparatus is held out of contact and allows the spool valve to move freely by means of its normal actuating mechanism thereby eliminating any need for increased minimum permissible operating pressure and eliminating any inbalance of forces acting on the movable member. Further, the positioning means is cycled at only a fraction of the number of times that the movable element is cycled thereby providing extremely long operating life and reducing its subjection to fatigue and wear.

In its broader aspects, the invention is a valve comprising in combination a housing having an internal bore and a plurality of fluid passageway communicating with the bore and a valve element mounted within the bore for movement within the bore between at least two positions for opening and closing said fluid passageways. A valve shifting means is provided for causing the valve element within the bore to move between its positions and for holding the valve element in one position after such movement. The shifting means is in an operating mode when said shifting means moves the valve element between its positions and holds the valve element in one position after such movement in a nonoperating mode when the shifting means neither moves the valve element between its positions nor holds it in one position.

A positioning means is provided for shifting the valve element to a predetermined position within the bore whenever the valve shifting means is in its nonoperating mode. The positioning means include at least one valve element contact means for contacting and positioning said valve element and position control means for moving said valve element contact means to and holding said contact means in a first position. In the first position, the valve element contact means are out of contact with said valve element to allow movement of said valve element by said valve shifting means when the shifting means is in its operating mode. The position control means also move the valve element contact means to and hold the valve element contact means in a second position in contact with the valve element for urging the valve element to said predetermined position within said bore when said shifting means is in its nonoperating mode.

In other aspects of the invention, the valve is a spool valve including a spool movably mounted within the bore while the valve shifting means are fluid operated by a source of fluid pressure. In the preferred embodiment, the positioning means include a piston mounted within a fluid chamber. The piston is operated between its two positions by the same source of fluid pressure as the spool member such that whenever the fluid pressure is absent from the valve, the spool will be urged to its predetermined position.

These and other objects, advantages, purposes, and features of the invention will become more apparent from a study of the following description taken in conjunction with the drawings.

BRIEF DESCRIPTION OF THE DRAWINGS

FIG. 1 is a sectional side elevation of a spool valve controlled by a single electric solenoid-operated pilot valve, the spool valve incorporating the valve positioner of the present invention at only one end with the positioners retracted and the spool valve in operative condition;

FIG. 2 is a sectional view of the interface and fluid passageways extending between the pilot valve and spool valve taken along plane II—II of FIG. 1;

FIG. 3 is a sectional plan view of the valve-positioning apparatus and spool valve taken along line III—III of FIG. 1;

FIG. 4 is a fragmentary, sectional side elevation of the spool valve and valve positioning apparatus of FIG. 1, but illustrating the positioning apparatus urging the spool into its predetermined position when the spool assembly is depressurized.

DESCRIPTION OF THE PREFERRED EMBODIMENT

Generally

Figure 5:
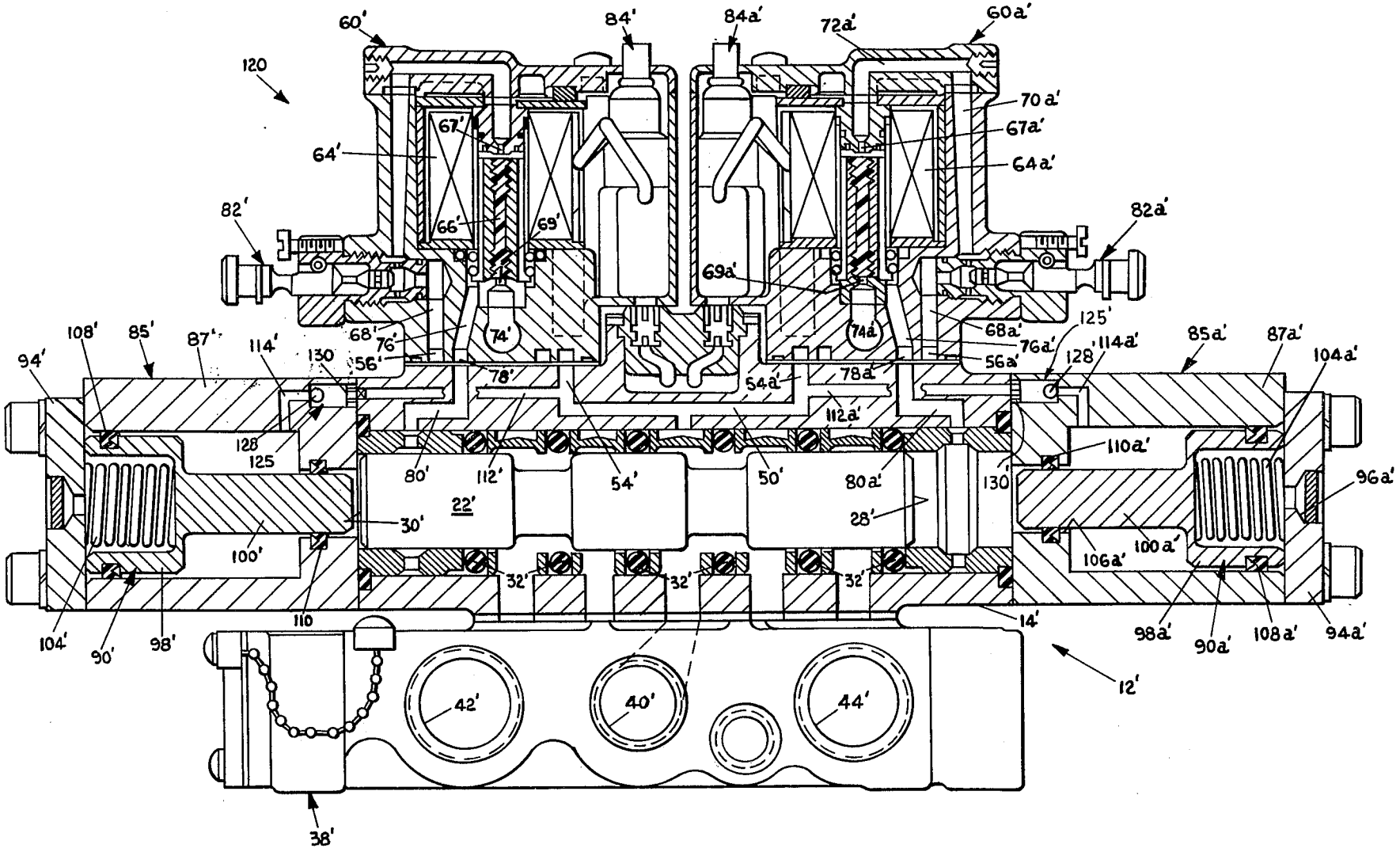
FIG. 5 is a sectional side elevation of a double, electric solenoid pilot valve operated spool valve incorporating the valve-positioning apparatus of the present invention on either end of the spool valve.

Referring now to the drawings in greater detail, the several figures illustrate the valve positioning apparatus installed on at least two embodiments of a fluid-operated spool valve assembly. The first embodiment 10, shown in FIGS. 1–4, is a single, solenoid pilot valve operated spool valve including valve-positioning apparatus on one end thereof. FIG. 5 illustrating a double, solenoid pilot valve operated spool valve assembly 100 including valve-positioning apparatus on either end thereof. Each embodiment 10 or 100 includes a spool valve unit 12 or 12', at least one electric, solenoid-operated, pilot valve 60 or 60', and at least one valve-positioning apparatus 85 or 85' on at least one end of the spool valve unit. The spool valve units 12, 12' are fluid operated via pneumatic pressure which shifts the elongated spool member axially within the unit as controlled by the operation of the solenoid-operated pilot valve. When the spool valve unit and pilot are depressurized, i.e., upon installation, during shut down, or during failure of fluid pressure for any reason, the valve-positioning apparatus 85, 85' operates to shift the spool members to a predetermined position.

SINGLE PILOT VALVE OPERATED SPOOL VALVE ASSEMBLY

Referring now to FIGS. 1–4, spool valve assembly 10 includes an elongated housing 14 including a rectilinear, cylindrical bore 16 extending therethrough from one end 18 to the other end 20. Shiftably mounted within the bore 16 is a spool shaft or movable valve member 22 which is generally cylindrical and includes a plurality of raised lands 24 and recessed grooves 26 between the lands. The spool shaft 22 has opposing ends 28, 30, and is supported on a plurality of flexible, resilient, synthetic, O-type annular sealing rings 32 spaced along and permanently located in fixed positions within the bore by rigid annular locating flanges 34. "O" rings 32 form a seal between the inside bore diameter and the lands of the spool shaft to provide a plurality of separate fluid chambers therebetween as shown in FIGS. 1, 3, and 4. An end cap 36 covers the right end 18 of spool valve unit 12 (FIG. 1) while the valve-positioning apparatus 85 is positioned at the other end 20. End cap 36 includes a port 37 extending therethrough to release any fluid pressure between the end cap and end 28 of the spool during operation.

Securing to the underside of the spool valve unit 12 is a base member 38 for insertion of fluid pressure to the spool valve unit 12 and for connection of the fluid conduits leading to and from a fluid-operated device (not shown) to be controlled by the valve assembly. Base 38 includes a fluid inlet 40, exhaust outlets 42 and 44, and fluid outlets 46 and 48 corresponding to exhaust outlets 42 and 44, respectively (FIG. 3). When the spool shaft 22 is in the position shown in FIG. 4 and in solid in FIG. 1, fluid from inlet 40 is directed to fluid outlet 46 while exhaust outlet 42 is closed. Further, in this position, fluid outlet 48 is in communication with fluid exhaust 44 to allow exhaustion of fluid pressure therethrough. When spool shaft 22 is shifted to the left from the above position, as shown in phantom in FIG. 1 and in solid in FIG. 3, fluid communication from inlet 40 is established with fluid outlet 48 while exhaust port 44 is closed. Further, fluid outlet 46 is in communication with fluid exhaust port 42 to allow exhaustion of fluid pressure therethrough.

As shown in FIGS. 1 and 4, a fluid passageway 50 extends from a chamber in bore 16 in fluid communication with fluid inlet 40 through the upper portion of housing 14 to a fluid chamber behind piston head 52 secured to the left end 30 of spool member 22. Branching from passageway 50 is fluid passageway 54 leading to an annular fluid passageway 56 in the base of solenoid-operated pilot valve 60 (FIGS. 1 and 2).

As shown in FIG. 1, solenoid-operated pilot valve 60 includes a housing 62 surrounding an annular, electric solenoid coil 64 which, when charged with electricity, magnetically raises a pilot plunger 66 mounted centrally therewithin. Plunger 66 opens and closes inlet orifice 67 and exhaust orifice 69 in a fluid passageway including portions 68, 70, and 72 and communicating with annular fluid passageway 57 at the base of the pilot valve. The pilot valve fluid passageway leads to an exhaust area 74 beneath orifice 69 as well as around plunger 66 to an exhaust branch 76 which communicates with another annular fluid passageway 78 leading to fluid passageway 80 in the upper portion of the valve housing 14. Passageway 80 leads to the fluid chamber at end 30 of spool valve 22 on the opposite side of piston head 52 from the end of passageway 50 such that fluid under pressure may be alternately inserted and exhausted from the end of the spool to shift the same as described above. Also provided in the pilot valve are a manual override valve 82 for manual actuation of the spool valve 22 when the pilot plunger 66 is not operated by the electrically operated solenoid 64. A push button switch is also provided for momentary, manual actuation of the pilot plunger via the electric-operated solenoid 64. Normally, operation of solenoid 64 is controlled by an electrical control (not shown) and indicated by pilot light 84. Pilot valve assemblies 60, 60' are of the type described in U.S. Pat. No. 2,861,592, issued Nov. 25, 1958, and 2,955,617 issued Oct. 11, 1960, both invented by J. E. Collins, assigned to the same assignee as the present invention, the disclosures of which are incorporated by reference herein.

As shown in FIGS. 1, 3, and 4, the valve-positioning apparatus 85 is positioned at one end of the spool valve unit 12 in assembly 10. Positioning apparatus 85 includes a fluid chamber 87 having a generally cylindrical internal bore 88 and a piston 90 movably mounted within the bore 88. Fluid chamber 87 includes side walls 89, 91, and end wall 92 defining the internal bore 88 enclosing piston 90. The fluid chamber is capped by an end cap 94 bolted to chamber 87 and including a port 96 providing an atmospheric pressure inlet to the chamber.

Piston 90 includes a right cylindrical portion 98 having a diameter approximately matching that of bore 88 and an elongated, solid, right cylindrical section 100 having a diameter less than that of portion 98 extending from one end of portion 98. The end of portion 98 opposite the end from which extension 100 projects is recessed at 102 to provide a seat for coil spring 104 as shown in FIGS. 1, 3, and 4. End wall 92 of chamber 87 includes a cylindrical aperture 106 having a diameter slightly larger than the diameter of extending section 100 of piston 90. A flexible resilient annular sealing ring 108 is seated in an annular recess around the side surfaces of piston section 98 and seals the gap between piston section 98 and the interior bore 88 of chamber 87 as the piston is reciprocated axially within the chamber. A second flexible annular sealing ring 110 mounted in an annular recess in aperture 106 in a fixed position provides a fluid-tight seal between the extension 100 and aperture 106.

Fluid motive power for reciprocating piston 90 within chamber 87 is provided via a fluid passageway or conduit 112 extending from the end of passageway 50 in housing 14. Passageway 112 connects with fluid passageway 114 in fluid chamber 87 which leads to the portion of the internal bore 88 between the two annular sealing rings 108, 110.

OPERATION OF SINGLE PILOT VALVE OPERATED SPOOL VALVE ASSEMBLY

At all times when fluid pressure from inlet 40 is present within housing 14 (i.e., when valve 10 is in an operating mode), fluid pressure is applied via conduits 50, 112, and 114 against the end surface of piston section 98 provided by the difference in diameters between section 98 and extension 100. This fluid pressure forces the piston to the left and into the position shown in FIGS. 1 and 3. Port 96 behind piston 90 prevents a build-up of fluid pressure which would resist piston movement. The strength of the coil spring 104 is chosen to allow the normal fluid pressure which operates spool 22, as controlled by pilot valve 60, to overcome the spring-biasing force and hold the piston member 90 in its retracted, withdrawn position. In that position, the end of extending section 100 is held out of contact with spool 22 regardless of the axial position of the spool.

When piston 90 is so retracted, spool 22 may be shifted in normal operation between its left and right positions as shown in FIG. 1 by the control of pilot valve assembly 60. When solenoid coil 64 is not energized, fluid pressure passes through passageways 54, 56, 68, 70, 72, and out orifice 67, alongside plunger 66, and through passageways 76, 78, and 80 to the left end of spool 22. Pressure against the end 30 of the spool and the left side of piston head 52 moves the spool to the right. Support 37 prevents a buildup of positive or negative pressure on the right end of the spool which would otherwise obstruct its movement.

When solenoid coil 64 is energized, pilot plunger 66 is raised closing orifice 67 and opening orifice 69. Pressure on the left end of the spool is exhausted through passageways 80, 78, 76, orifice 69, and exhaust passageway 74. At the same time, fluid pressure from inlet 40 passes through passageway 50 to the right side of piston head 52 to move the spool to the left. Thus, during normal operation of the spool, the positioning apparatus remains out of contact with the spool and in no sense obstructs or resists its movement.

The presence of fluid pressure at the left end 30 of spool 22 and the use of the block Vee (Trademark of Chicago Rawhide Co.) type or equivalent annular sealing ring 110 allows some fluid pressure to bleed past the sealing ring (from right to left in FIGS. 1 and 4) into the fluid chamber 87 to help hold the piston in its retracted position. However, the V-shape of annular sealing ring 110 prevents fluid passage in the opposite direction such that exhaust can take place only through passageway 114.

Upon the failurre or absence of the fluid pressure in inlet 40 (i.e., when valve 10 is in a nonoperating mode), and thus in fluid conduits 50, 112, and 114, fluid pressure in chamber 87 is reduced and the biasing force of spring 104 forces the piston member to the right (FIG. 4). Movement of piston 90 to the right brings extension 100 into contact with left end 30 of spool 22 thereby shifting spool 22 to the right into the position shown in FIG. 4. Thus, upon installation, during shutdown, or failure of fluid pressure, the spool in embodiment 10 will always be returned to the predetermined right-hand position in order to accurately determine the operational mode of the machinery controlled by the spool valve assembly.

DOUBLE PILOT VALVE OPERATED SPOOL VALVE ASSEMBLY

Referring now to FIG. 5, a second embodiment 120 of a spool valve assembly is shown incorporating the present invention. Embodiment 120 is a double, solenoid pilot valve operated, spool valve assembly including a pair of electric solenoid-operated pilot valves 60' and **60*a'* which positively control axial movement of spool 22'. Generally, embodiment 120 includes very similar structural elements to those in embodiment 10, which elements are designated by the same numerals as used in the explanation of embodiment 10** but including primes thereon.

As shown in FIG. 5, spool valve unit 12' includes a housing 14' and an axially shiftable spool 22' mounted within a bore 16' and sealed by a plurality of spaced, annular, flexible, resilient, sealing rings 32'. A valve-positioning apparatus 85' is mounted on the left end in axial alignment with the left end of spool 22' while a second valve-positioning apparatus **85*a'* is mounted on the right end of the spool unit also in axial alignment with the spool. Fluid passageways 112', 112*a'* extend in housing 14' from passageway 50' to positioners 85', 85*a'*, respectively, for operation of these positioners. Pilot valve 60' controls insertion and exhaust of fluid pressure from fluid inlet 40 to the left end of the spool 22' through fluid passageway 80' while pilot valve 60*a'*** controls insertion and exhaust of fluid pressure to the right end of the spool through fluid passageway 80a'. Spool 22' does not include any type of piston head such as piston head 52 in embodiment 10 above since fluid pressure is directed against opposite ends of the spool for movement instead of against opposite sides of such a piston head.

Valve-positioning apparatuses 85', 85a' are shown in FIG. 5 in their retracted, withdrawn positions out of contact with the spool such that the spool may be operated by the pilot valve assemblies in normal operation. Valve-positioning apparatuses 85', 85a' differ from apparatus 85 by the inclusion of fluid check valves 125, 125' between fluid passageways 112', 114' and 112a' and 114a', respectively. Check valves 125, 125' include fluid chambers 126, 126' in which are mounted ball checks 128 and 128', respectively, and screen or filter elements 130, 130', respectively, which retain the ball checks within the chambers. When fluid pressure, as controlled by pilot valve 60' or 60a' is inserted in bore 16' adjacent one of the ends 28', 30' of spool 22', fluid check valves 125, 125' prevent pilot control air in passageways 50', 112', and 112a' from entering into and retracting piston members 90' or 90a' until after the spool 22' is moved by the fluid pressure. Hence, fluid pressure within the bore chambers adjacent the end of the spool bleeds past either Block Vee (Trademark) type or equivalent annular sealing ring 110' or 110a' in the manner described above for embodiment 10 to fill the fluid chambers 87' or 87a' and retract the respective piston members. The pistons thus contact and maintain the spool position until after the spool is moved in the normal manner by the fluid pressure.

The two valve-positioning apparatuses 85', 85a' operate to center the spool 22' when the strength of the coil springs 104', 140a' are equivalent. However, embodiment 120 can also be operated with but one of the valve positioning apparatuses on either end of the housing 14'. Further, the strengths of the springs 104', 104a' can be altered when the two opposing positioning apparatuses are used such that the spool is brought to any intermediate position along its path of axial movement other than a centered position inbetween the two valve-positioning apparatuses.

OPERATION OF DOUBLE PILOT VALVE OPERATED SPOOL VALVE ASSEMBLY

As shown in FIG. 5 with both solenoid coils 64', 64a' de-energized, both pilot plungers 66' 66a' are held in the down position with exhaust orifices 69', 69a' closed and inlet orifices 67', 67a' open. Pilot air from inlet 40' flows through passageways 50, 54' and 54a', 56, and 56a', 68' and 68a', 70' and 70a', 72' and 72a' and through outlet orifices 67' and 67a'. Thereafter, the fluid passes through passageways 76' and 76a', 80' and 80a' to either end of spool 22' such that pressure is equalized and the spool is held in the position in which it was originally. The fluid pressure provided to either end of the spool bleeds past annular sealing rings 110', 110a' into fluid chambers 87', 87a' thereby retracting the piston members 90', 90a' and holding them in the position shown in FIG. 5 out of contact with either end of the spool 22'. Simultaneously, ball check valves 125, 125' prevent fluid pressure from entering fluid chambers 87', 87a' through passageways 114', 114a' until after the ends of the spool valve are pressurized as above.

Upon energization of either of the solenoid coils, for instance solenoid 64', plunger 66' is raised closing orifice 67' and allowing fluid from the chamber adjacent end 30' of spool 22' to be exhausted through passgeways 80', 78', exhaust orifice 69', and exhaust passageway 74'. The fluid pressure acting against the right-hand end of the spool 28' thereby shifts the spool to the left to the position shown in FIG. 5. At all times during such movement, both piston members 90', 90a' are held in their retracted positions because the fluid pressure cannot escape from chambers 87', 87a' past fluid seals 110', 110a' and the fluid pressure in passageways 112', 112a' holds ball checks 125 and 125' closed. Likwise, if the solenoid coil 64a' in pilot valve 60a' is operated, the spool will move to the left while the piston members remain retracted.

If, however, at any time fluid pressure from inlet 40' fails, is shut down or absent, fluid pressure in fluid passageways 50', 112', and 112a', and thus in passageways 114', 114a', is relieved and reduced. The ball checks 125 and 125' are opened and fluid pressure drops within the fluid chambers 87' and 87a' allowing biasing springs 104', 104a' to shift the piston members toward and into contact with spool 22' to shift the spool to its predetermined position. Ports 96', 96a' relieve any pressure or vacuum behind the piston members such that their movement is not obstructed in any manner.

It will be understood that the positioning apparatus 85, 85', or 85a' may be used alone or in pairs with spool or other valves which are operated manually, with fluid pressure or otherwise than with fluid pressure. In such cases, it is necessary only to have a mechanism for holding the positioner away from the spool during the normal operation of the spool valve. In the preferred embodiment, such mechanism is a fluid-operated mechanism as described above. It will also be apparent that the present valve positioning apparatus can be used with virtually any type of valve having a movable valve sealing element which must be positioned in a predetermined position when the valve is not operating, is shut down, or otherwise fails.

While several forms of the invention have been shown and described, other forms will now be apparent to those skilled in the art. It will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows.

1. A valve comprising an combination:

a housing having a first internal passageway and a plurality of second fluid passageways communicating with said first passageway;

a valve element mounted within said first passageway for movement therewithin between at least two positions for opening and closing said second fluid passageways;

valve shifting means for causing said valve element to move within said first passageway between its positions and for holding said valve element in one position after such movement, said valve shifting means being in an operating mode when it moves said valve element between said two positions and holds said valve element in one of said positions; said valve shifting means being in a nonoperating mode when it neither moves said valve element between its positions nor holds it in one of said positions;

positioning means for shifting said valve element to a predetermined position within said first passageway whenever said valve shifting means is in said nonoperating mode, said positioning means including at least one valve element contact means for contacting and positioning said valve element and position control means for moving said valve contact means to a first position out of contact with said valve element to allow movement of said valve element by said valve shifting means when said shifting means is in said operating mode and for moving said valve element contact means to a second position in contact with said valve element for urging said valve element to said predetermined position within said first passageway when said shifting means is in its nonoperating mode;

second control means for allowing movement of said valve element contact means to its first position only after said valve element is positioned in said predetermined position by said valve shifting means in said operating mode;

said position control means including fluid-operated, fluid pressure responsive means responsive to said valve shifting means being in said operating mode for moving said valve element contact means to and holding said valve element contact means in said first position and a third fluid passageway for conducting fluid under pressure from a source of fluid pressure to said fluid pressure responsive means;

said fluid pressure responsive means including fluid chamber means for housing at least a portion of said valve element contact means and providing a fluid-tight chamber around at least said portion; said third fluid passageway communicating with said fluid-tight chamber for movement of said valve element contact means between said first and second positions; and biasing means for urging said valve element contact means toward its second position whereby when said valve shifting means is in its operating mode and fluid pressure is present in said third fluid passeway and said fluid-tight chamber, said valve element contact means is held in its first position against the force of said biasing means, and whenever said valve shifting means is in its nonoperating mode and fluid pressure is not present in said third fluid passageway and said fluid-tight chamber, said biasing means urges said valve element contact means into its second position to move said valve element to its predetermined position.

2. The valve of claim 1 wherein said valve is a spool valve, said valve element comprising an elongated spool within said first passageway in said spool valve, said valve shifting means being fluid operated and including fluid conduits communicating with said source of fluid pressure and internal portions of said first passageway in said housing and control valve means for controlling insertion and exhaustion of fluid under pressure to said first passageway through said fluid conduits such that when fluid pressure is present, said valve shifting means is in its operating mode and said valve element contact means is held in its first position.

3. The valve of claim 1 wherein said valve is a spool valve, said valve element comprising an elongated spool within said first passageway in said spool valve, said fluid chamber means being mounted on one end of said housing, said housing having an aperture extending through said one end in alignment with said spool; said spool contact means including a piston member mounted for movement within said fluid chamber between the said two positions, said piston member being in axial alignment with said spool and including a portion adapted to extend through said housing aperture into contact with one end of said spool when said piston member is in said second position; and sealing means between said fluid chamber means and piston member to provide said fluid-tight chamber about said piston member.

4. The valve of claim 3 wherein a combination of said fluid chamber means, said piston member and sealing means is mounted on each end of said housing in axial alignment with either end of said spool whereby whenever fluid pressure is absent, said piston members contact either end of said spool to move said piston to a predetermined position.

5. The valve of claim 3 wherein said fluid chamber means includes a plurality of walls forming an enclosure, at least one wall having an aperture therethrough in alignment with said housing aperture and at least one wall opposite said one wall; said piston member including a first portion having opposite ends and a first diameter and a second portion extending from one end of said piston member into said aperture in said one wall of said fluid chamber enclosure and having a lesser diameter than said first diameter; said sealing means including a first seal in sealing engagement between said fluid chamber enclosure and said first portion of said piston member and a second seal in sealing engagement between the perimeter of said fluid chamber enclosure aperture and said second portion of said piston member.

6. The valve of claim 5 wherein said wall opposite said one wall includes an aperture therethrough to admit atmospheric pressure behind said piston member; said first piston member including a recess in the end thereof opposite said one end; said biasing means including a coil spring seated in said recess and extending against said wall opposite said one wall of said fluid chamber enclosure.

7. A valve comprising in combination:

a housing having a first internal passageway and a plurality of second fluid passageways communicating with said first passageway;

a valve element mounted within said first passageway for movement therewithin between at least two positions for opening and closing said second fluid passageways;

valve shifting means for causing said valve element to move within said first passageway between its positions and for holding said valve element in one position after such movement, said valve shifting means being in an operating mode when it moves said valve element between said two positions and holds said valve element in one of said position; said valve shifting means being in a nonoperating mode when it neither moves said valve element between its positions nor holds it in one of said positions;

positioning means for shifting said valve element to a predetermined position within said first passageway whenever said valve shifting means is in said nonoperating mode, said positioning means including at least one valve element contact means for contacting and positioning said valve element and position control means for moving said valve contact means to a first position out of contact with said valve element to allow movement of said valve element by said valve shifting means when said shifting means is in said operating mode and for moving said valve element contact means to a second position in contact with said valve element for urging said valve element to said predetermined position within said first passageway when said shifting means is in its nonoperating mode;

second control means for allowing movement of said valve element contact means to its first position only after said valve element is positioned in said predetermined position by said valve shifting means in said operating mode;

said valve being a spool valve, said valve element comprising an elongated spool within said first passageway in said spool valve, said valve shifting means being fluid operated and including fluid conduits communicating with a source of fluid pressure and internal portions of said first passageway in said housing and control valve means for controlling insertion and exhaustion of fluid under pressure to said first passageway through said fluid conduits such that when fluid pressure is present, said valve shifting means is in its operating mode and said valve element contact means is held in its first position;

said control valve means including at least two electric, solenoid-operated fluid pilot valves, one of said pilot valves adapted to control movement of said spool in one direction in said first passageway and the other of said pilot valves adapted to control movement of said spool in the opposite direction in said first passageway.

8. A valve comprising in combination:

a housing having a first internal passageway and a plurality of second fluid passageways communicating with said first passageway;

a valve element mounted within said first passageway for movement therewithin between at least two positions for opening and closing said second fluid passageways;

valve shifting means for causing said valve element to move within said first passageway between its positions and for holding said valve element in one position after such movement, said valve shifting means being in an operating mode when it moves said valve element between said two positions and holds said valve element in one of said positions; said valve shifting means being in a nonoperating mode when it neither moves said valve element between its positions nor holds it in one of said positions;

positioning means for shifting said valve element to a predetermined position within said first passageway whenever said valve shifting means is in said nonoperating mode, said positioning means including at least one valve element contact means for contacting and positioning said valve element and position control means for moving said valve contact means to a first position out of contact with said valve element to allow movement of said valve element by said valve shifting means when said shifting means is in said operating mode and for moving said valve element contact means to a second position in contact with said valve element for urging said valve element to said predetermined position within said first passageway when said shifting means is in its nonoperating mode;

second control means for allowing movement of said valve element contact means to its first position only after said valve element is positioned in said predetermined position by said valve shifting means in said operating mode;

said position control means including fluid-operated, fluid pressure responsive means responsive to said valve shifting means being in said operating mode for moving said valve element contact means to and holding said valve element contact means in said first position and a third fluid passageway for conducting fluid under pressure from a source of fluid pressure to said fluid pressure responsive means;

said valve shifting means being fluid operated; said second control means including fluid seal means between said valve element contact means and said fluid operated valve shifting means for allowing fluid movement therepast only to move said valve element contact means to its first position, and check valve means in said third fluid passeway for preventing fluid passage to said fluid pressure responsive means through said third fluid passageway until after said valve element is positioned in said predetermined position by fluid and fluid has moved past said fluid seal means to move said valve element contact means to its first position.

9. The valve of claim 8 wherein said valve is a spool valve, said valve element comprising an elongated spool within said first passageway in said spool valve, said valve shifting means including fluid conduits communicating with a source of fluid pressure and internal portions of said first passageway in said housing and control valve means for controlling insertion and exhaustion of fluid under pressure to said first passageway through said fluid conduits such that when fluid pressure is present, said valve shifting means is in its operating mode and said valve element contact means is held in its first position.

10. The valve of claim 9 wherein said control valve means include at least one electric, solenoid-operated fluid pilot valve.

11. In a spool valve including a housing having a bore therein and a plurality of fluid passageways interconnecting with said bore, an axially shiftable spool having opposite ends and mounted in said bore and adapted to be shifted to open and close various of said fluid passageways, means for axially shifting said spool to open and close said passageways, and means for inserting a fluid under pressure into at least one of said fluid passageways; the improvement comprising:

spool positioning means for shifting said spool to a predetermined axial position within said bore whenever fluid pressure fails or is absent in said one fluid passageway, said positioning means including an aperture axially aligned with one of said ends of said spool through at least one end of said housing; a generally closed fluid chamber mounted on at least said one housing end and generally covering said aperture; a piston mounted for movement in said fluid chamber in alignment with the axis of said spool between a first position in which said piston is withdrawn out of contact with said spool and a second position in which a portion of said piston extends through said housing aperture and contacts said one end of said spool to shift said spool to said predetermined axial position within said bore, the entirety of said piston being located beyond said one end of said spool at all times; sealing means for sealing said piston within said fluid chamber; biasing means for biasing said piston toward its second position; and a fluid passageway connected in fluid communcation with said fluid under pressure in said one fluid passageway for admitting a fluid under pressure against said piston within said chamber whereby whenever fluid pressure is present in said one fluid passageway, said piston is withdrawn to its first position against the force of said biasing means but when the fluid pressure fails or is absent, said piston is moved by said biasing means to its second position to contact said one end of said spool and shift said spool to said predetermined position; said means for axially shifting said spool being fluid operated; said sealing means including fluid seal means between said piston and said fluid-operated means for axially shifting said spool for allowing fluid movement therepast only to move said piston to its first position, and check valve means in said fluid passageway which admits pressure against said piston for preventing fluid passage to said piston through the said fluid passageway until after said spool is positioned in said predetermined axial position by fluid and fluid has moved past said fluid seal means to move said piston to its first position.

12. The spool valve of claim 11 wherein said fluid chamber includes a plurality of walls, at least one wall having an aperture therethrough in alignment with said housing aperture; said piston including a first portion having opposite ends and a first diameter and a second portion extending from one end of said piston into said aperture in said one wall of said fluid chamber and having a lesser diameter than said first diameter.

13. The spool valve of claim 12 wherein said fluid seal means includes a first seal in sealing engagement between said fluid chamber and said first portion of said piston and a second seal in sealing engagment between the perimeter of said fluid chamber aperture and the second portion of said piston which allows said fluid movement therepast.

14. The spool valve of claim 13 including a recess in the end of said first piston portion opposite said one end; a wall of said fluid chamber opposite said one wall; said biasing means including a coil spring seated in said recess and extending against said opposite wall of said fluid chamber.

15. The spool valve of claim 14 wherein said opposite wall includes an aperture therethrough to admit atmospheric pressure behind said piston.

16. The spool valve of claim 11 wherein said piston includes an extending portion on one end and adapted to extend through said housing aperture to contact said spool when said piston is in its second position; said biasing means being located between a wall of said fluid chamber and the end of said piston opposite said extending portion whereby said biasing means acts against said piston and urges said extending portion through said housing aperture.

* * * * *

UNITED STATES PATENT AND TRADEMARK OFFICE

CERTIFICATE OF CORRECTION

PATENT NO. : 4,046,165
DATED : September 6, 1977
INVENTOR(S) : Robert C. Rose, Sr. et al.

It is certified that error appears in the above-identified patent and that said Letters Patent are hereby corrected as shown below:

Column 3, Line 44;

"illustrating" should be --illustrates--.

Column 3, Line 55;

"pilot are" should be --pilot valves are--.

Column 4, Line 52;

"57" should be --56--.

Column 5, Line 4;

"U. S. Pat. No." should be --United States Patent--.

Column 6, Line 19;

"block Vee" should be --Block Vee--.

Column 6, Line 24;

"V-shape" should be --"V" shape--.

Column 6, Line 28;

"failurre" should be --failure--.

Column 8, Line 50;

"an" should be --in--.

UNITED STATES PATENT AND TRADEMARK OFFICE

CERTIFICATE OF CORRECTION

PATENT NO. : 4,046,165

DATED : September 6, 1977

INVENTOR(S) : Robert C. Rose, Sr. et al.

It is certified that error appears in the above-identified patent and that said Letters Patent are hereby corrected as shown below:

Column 9, Line 41;

"passeway" should be --passageway--.

Column 12, Line 17;

"passeway" should be --passageway--.

Column 14, Line 6;

"engagment" should be --engagement--.

Signed and Sealed this

Ninth Day of May 1978

[SEAL]

Attest:

RUTH C. MASON
Attesting Officer

LUTRELLE F. PARKER
Acting Commissioner of Patents and Trademarks